US009393787B2

(12) United States Patent
Ikushima

(10) Patent No.: US 9,393,787 B2
(45) Date of Patent: Jul. 19, 2016

(54) METHOD AND APPARATUS FOR DISCHARGING LIQUID MATERIAL

(71) Applicant: Musashi Engineering, Inc., Mitaka-shi, Tokyo (JP)

(72) Inventor: Kazumasa Ikushima, Tokyo (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 0 days.

(21) Appl. No.: 14/852,060

(22) Filed: Sep. 11, 2015

(65) Prior Publication Data

US 2015/0375507 A1 Dec. 31, 2015

Related U.S. Application Data

(63) Continuation of application No. 12/600,823, filed as application No. PCT/JP2008/001241 on May 19, 2008, now Pat. No. 9,156,054.

(30) Foreign Application Priority Data

May 18, 2007 (JP) ..... 2007-132440

(51) Int. Cl.
*B41J 29/393* (2006.01)
*B41J 2/14* (2006.01)
(Continued)

(52) U.S. Cl.
CPC ..... *B41J 2/1433* (2013.01); *B05B 12/06* (2013.01); *B05C 5/02* (2013.01); *B05C 11/1034* (2013.01);
(Continued)

(58) Field of Classification Search
CPC ..... B41J 29/3935; B41J 2/125; B41J 2/0451; B41J 2/2142; B41J 11/0095; B05C 5/02; B05C 12/06
See application file for complete search history.

(56) References Cited

U.S. PATENT DOCUMENTS 4,819,831 A * 4/1989 Green ..... B01J 2/08 222/420
5,627,571 A * 5/1997 Anderson ..... B41J 2/125 347/19

(Continued)

FOREIGN PATENT DOCUMENTS

JP 4-041242 A 2/1992
JP 11-227172 A 8/1999

(Continued)

OTHER PUBLICATIONS

International Search Report of PCT/JP2008/001241, mailing date of Sep. 2, 2008.

(Continued)

*Primary Examiner* — Lamson Nguyen
(74) *Attorney, Agent, or Firm* — Westerman, Hattori, Daniels & Adrian, LLP

(57) ABSTRACT

[Object] To provide a method and apparatus for discharging a liquid material, which can solve the problems regarding the occurrence of a satellite and accuracy of a landing position. [Solving Means] In a method for discharging a liquid material in the state of a liquid droplet through a discharge orifice by applying inertial force to the liquid material, the method is characterized in comprising the steps of measuring a distance A from a lower end of the discharge orifice to a lower end of the liquid material having flowed out from the discharge orifice at the time when the liquid material having flowed out from the discharge orifice separates from the discharge orifice, and setting a distance B between the lower end of the discharge orifice and a work surface to be approximately the same as the distance A. An apparatus for carrying out the method is also provided.

14 Claims, 7 Drawing Sheets

(51) Int. Cl.

| | |
|---|---|
| ***B05B 12/06*** | (2006.01) |
| ***B05C 5/02*** | (2006.01) |
| ***B05C 11/10*** | (2006.01) |
| ***B41J 2/045*** | (2006.01) |

(52) U.S. Cl.

CPC ..... *B41J 2/0458* (2013.01); *B41J 2/04516* (2013.01); *B41J 2/04556* (2013.01); *B41J 2/04581* (2013.01); *B41J 2202/05* (2013.01)

(56) References Cited

U.S. PATENT DOCUMENTS

| | | | |
|---|---|---|---|
| 5,815,282 | A | 9/1998 | Kano |
| 6,815,001 | B1 | 11/2004 | Mishima et al. |
| 7,249,830 | B2 | 7/2007 | Hawkins et al. |
| 8,529,011 | B2 | 9/2013 | Govyadinov |
| 2005/0045653 | A1 | 3/2005 | Tanaka et al. |
| 2005/0212837 | A1 | 9/2005 | Nakagawa et al. |
| 2005/0253890 | A1 | 11/2005 | Nagashima |
| 2006/0279601 | A1 | 12/2006 | Unosawa et al. |
| 2007/0064037 | A1 | 3/2007 | Hawkins et al. |
| 2009/0079105 | A1 | 3/2009 | Nishimori et al. |
| 2010/0156970 | A1 | 6/2010 | Ikushima |

FOREIGN PATENT DOCUMENTS

| | | | |
|---|---|---|---|
| JP | 2001-500962 | A | 1/2001 |
| JP | 2001-232276 | A | 8/2001 |
| JP | 2003-053237 | A | 2/2003 |
| JP | 2003-190871 | A | 7/2003 |
| JP | 2005-040770 | A | 2/2005 |
| JP | 2005066391 | A | 3/2005 |
| JP | 2005-296700 | A | 10/2005 |
| JP | 2005279628 | A | 10/2005 |
| JP | 2006-192590 | A | 7/2006 |
| TW | 1361726 | B | 4/2012 |
| WO | 00/45964 | A1 | 8/2000 |

OTHER PUBLICATIONS

Translation of Fukushima patent document, JP 4-41242, also 04041242, published Feb. 12, 1992, for the USPTO.

Office Action dated Feb. 24, 2016, issued in counterpart Korean Application No. 10-2015-7030772 (14 pages).

* cited by examiner

METHOD AND APPARATUS FOR DISCHARGING LIQUID MATERIAL

CROSS-REFERENCE TO RELATED APPLICATIONS

This application is a Continuation of U.S. application Ser. No. 12/600,823, filed Jan. 25, 2010, and wherein U.S. application Ser. No. 12/600,823 is a national stage application filed under 35 USC §371 of International Application No. PCT/JP2008/001241, filed May 19, 2008, and which is based upon and claims the benefit of priority from the prior Japanese Patent Application No. 2007-132440, filed on May 18, 2007, the entire contents of which are incorporated herein by reference.

TECHNICAL FIELD

The present invention relates to a liquid material discharging method and apparatus for discharging a liquid material by separating the liquid material from a nozzle after the liquid material has come into contact with a work. More particularly, the present invention relates to a liquid material discharging method and apparatus for coating the liquid material in dotted form by applying inertial force to the liquid material.

In this description, the term "liquid material" means all kinds of materials having fluidity. For example, a liquid material containing a particulate minute substance, called a filler, is also of course involved in the "liquid material".

Also, the term "state of liquid droplet" means a state where the liquid material having been discharged from a discharge orifice moves in a space without contacting the discharge orifice and an application (coating) target.

BACKGROUND ART

In one example of known liquid droplet discharging apparatuses for making the liquid material land on a work after the liquid material has separated from a nozzle, a plunger rod is disposed in a flow passage having a valve seat near an outlet communicating with the nozzle such that a lateral surface of the plunger rod is not in contact with the flow passage, and the liquid material is discharged from the nozzle by moving a fore end of the plunger rod to the valve seat for striking against the valve seat (Patent Document 1).

Also, as a technique of causing the liquid material to fly out in droplet form by quickly advancing a plunger and abruptly stopping the plunger without striking it against a valve seat, the applicant has previously proposed a liquid material discharging method and apparatus in which a liquid material discharging plunger having a fore end surface held in close contact with the liquid material is advanced at a high speed, and a plunger driving means is then abruptly stopped, whereupon the liquid material is discharged by application of inertial force to the liquid material (Patent Documents 2 and 3).

An ink jet printer is a liquid material discharging apparatus that discharges ink in the state of a liquid droplet. The discharge amount of an ink droplet has been reduced year by year. Recently, an ink jet printer having the discharge amount of 30 pico-liter or less has also been provided. In such an ink jet printer discharging the ink droplet in a very small amount, the distance from a nozzle to a sheet of paper, called a nozzle-to-sheet distance, is as short as 1.0 mm to 1.5 mm. Further, an ink jet head is moved at a high speed of 500 mm to 2000 mm/sec (Patent Document 4).

Patent Document 1: PCT Japanese Translation Patent Publication No. 2001-500962

Patent Document 2: Japanese Patent Laid-Open Publication No. 2003-190871

Patent Document 3: Japanese Patent Laid-Open Publication No. 2005-296700

Patent Document 4: Japanese Patent Laid-Open Publication No. 2006-192590

DISCLOSURE OF THE INVENTION

Problems to be Solved by the Invention

The method of discharging the liquid material so as to fly out in droplet form by applying inertial force to the liquid material has the problem that a satellite (minute droplet) smaller than a usual liquid droplet is formed, thus resulting in landing of the liquid material at an undesired position. Because the satellite brings about the problem of a short circuit, it is important to prevent the formation of the satellite.

When the liquid material is discharged to fly out in droplet form from the discharge orifice, the liquid droplet advance at a certain flying angle. If the flying angle is set to be not vertical, a deviation of the landing position is increased as the distance between the discharge orifice and the work increases.

Further, an increase in the distance between the discharge orifice and the work gives rise to the so-called rebounding upon the landing of the liquid droplet. The occurrence of the rebounding brings about the problem that the liquid droplet is not located at the desired position and hence a positional deviation is generated.

Meanwhile, there is also known a method for discharging a liquid material in a state where the liquid material has come into contact with a work (i.e., in a wetted state) as shown in FIG. 4. In that method, when the liquid material is a viscous material such as a creamy solder, the liquid material having flowed out from a discharge orifice, e.g., a nozzle, comes into a state where the liquid material is still clung to the discharge orifice even after the liquid material has contacted with a work such as a substrate. This results in the necessity of cutting the liquid material, which extends in the form of a string, by raising the discharge orifice. The necessity of raising and lowering the discharge orifice reduces productivity in operation of discharging the liquid material.

It is an object of the present invention to provide a method and apparatus for discharging a liquid material, which can solve the above-described problems.

Means for Solving the Problems

[1] A method for discharging a liquid material in the state of a liquid droplet through a discharge orifice by applying inertial force to the liquid material, the method comprising the steps of measuring a distance A from a lower end of the discharge orifice to a lower end of the liquid material having flowed out from the discharge orifice at the time when the liquid material having flowed out from the discharge orifice separates from the discharge orifice, and setting a distance B between the lower end of the discharge orifice and a work surface to be approximately the same as the distance A.

[2] A method for discharging a liquid material in the state of a liquid droplet through a discharge orifice by applying inertial force to the liquid material, the method comprising the steps of measuring a distance A from a lower end of the discharge orifice to a lower end of the liquid material having flowed out from the discharge orifice at the time when the liquid material having flowed out from the discharge orifice separates from the discharge orifice, and setting the distance B to a value in a range of 60 to 100% of the distance A.

[3] A method for discharging a liquid material through a discharge orifice by generating pressure in a liquid chamber which is communicated with the discharge orifice, the method being characterized in comprising a first step of measuring a distance A from a lower end of the discharge orifice to a lower end of the liquid material having flowed out from the discharge orifice at the time when the liquid material having flowed out from the discharge orifice separates from the discharge orifice, a second step of setting a distance B between the lower end of the discharge orifice and a work surface to be approximately the same as the distance A, and a third step of generating pressure in the liquid chamber to discharge the liquid material.

[4] The method for discharging the liquid material according to [1], [2] or [3], wherein the liquid material having flowed out from the discharge orifice separates from the discharge orifice after landing on a work.

[5] The method for discharging the liquid material according to any one of [1] to [4], wherein the liquid material is discharged while a work and the discharge orifice are horizontally moved relative to each other.

[6] The method for discharging the liquid material according to [5], wherein a distance measuring device for measuring the distance B is provided and the discharge orifice is moved up and down to hold the distance B constant.

[7] The method for discharging the liquid material according to any one of [1] to [6], wherein a discharge amount of the liquid material is not more than 100 mg.

[8] An apparatus for discharging a liquid material, comprising a discharge section including a discharge orifice, a work holding mechanism for holding a work at a position opposed to the discharge orifice, a discharge distance adjusting mechanism capable of adjusting a distance between a lower end of the discharge orifice and a work surface, a discharge distance measuring device for measuring the distance between the lower end of the discharge orifice and the work surface, and a main control section, wherein, on the basis of a previously measured distance A from the lower end of the discharge orifice to a lower end of the liquid material having flowed out from the discharge orifice at the time when the liquid material having flowed out from the discharge orifice separates from the discharge orifice, the main control section adjusts a distance B between the lower end of the discharge orifice and the work surface to be approximately the same as the distance A.

[9] The apparatus for discharging the liquid material according to [8], further comprising a horizontally relatively moving mechanism for horizontally moving the work and the discharge orifice relative to each other, wherein the main control section moves the discharge orifice up and down to hold the distance B constant.

[10] The apparatus for discharging the liquid material according to [8] or [9], wherein the apparatus is an ink jet type discharging apparatus.

[11] The apparatus for discharging the liquid material according to [8] or [9], wherein the apparatus is a jet type discharging apparatus.

Effect of the Invention

The present invention can solve the problems regarding the occurrence of a satellite and the accuracy of a landing position.

Also, because of no necessity of cutting the liquid material, which extends in the form of a string, by raising the discharge orifice, a time required for the operation of raising and lowering the discharge orifice is no longer required and productivity of the discharging operation can be improved.

DESCRIPTION OF REFERENCE CHARACTERS

Figure 1:
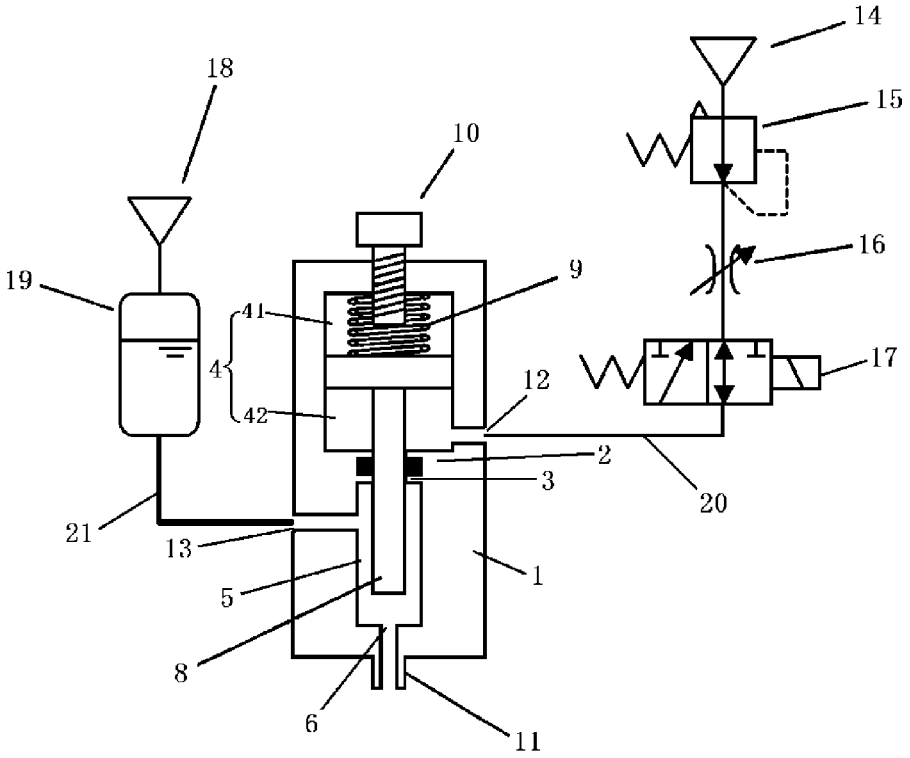
FIG. 1 is a schematic view of a discharging apparatus according to Embodiment 1 in a valve open state (first position).

A legend of main reference characters used in the drawings is as follows:

1 valve main body/2 partition/3 through-hole/4 driver chamber/5 liquid chamber/6 outlet of liquid chamber/7 piston/8 plunger rod/9 spring/10 stroke adjusting screw/11 nozzle/12, 13 connection ports/14 pneumatic source/15 valve operating pressure controller/16 flow control valve/17 selector valve/18 liquid pressurizing device/19 liquid reservoir/20, 21 pipes/30 work/41 spring chamber/42 air chamber/51 spring/52 piston/53 piston chamber/54 guide/55 plunger/56 liquid chamber/57 discharge orifice/61 control unit/62 air supply device/63 syringe/64 syringe attachment member/71, 371 X-direction moving mechanism/72 sensor device/73, 373 Y-direction moving mechanism/74, 374 work/75, 375 table/91 table/92 beam/93 Y-axis slider/94 applying head/95 X-axis slide base/96 X-axis slider/200 liquid material applying apparatus/300, 500 discharging apparatuses/301 desktop robot/303 Z-direction moving mechanism/400 gantry type applying apparatus/501 base/502 support plate/503 plate (top)/504 intermediate plate/511 reservoir/512 weighing section/513 plunger/514 plunger driving motor/516 cylindrical portion/526 valve member/28 valve driving motor/529 valve driving actuator/531 nozzle/532 discharge orifice/550 main body/553 tube/554 liquid feed tube/561 cover/581 first flow passage/582 second flow passage/583 third flow passage/584 fourth flow passage/585 fifth flow passage/591 joint/600 discharge head/601 ink jet head/602 head holding member/603 selector valve/604 touch sensor/605 base/606 flow passage block/611 first supply tube/612 second supply tube/614 valve driving power line/615 head supply tube/616 signal line/621, 622 joints/623, 624 fixing members (screws)/641 moving element.

BEST MODE FOR CARRYING OUT THE INVENTION

The best mode for carrying out the present invention will be described below, by way of example, in connection with a plunger jet type discharging apparatus in which a liquid material is discharged by applying inertial force to the liquid material through the steps of moving a plunger forwards and then abruptly stopping the plunger.

The illustrated plunger jet type discharging apparatus comprises a valve main body having a discharge orifice, a plunger rod for discharging the liquid material with forward and backward movements thereof, a liquid reservoir for supplying the liquid material to the valve main body, a liquid pressurizing device for pressurizing a liquid within the liquid reservoir to a desired pressure, a valve operating pressure controller for controlling valve operating air to a desired pressure, an electromagnetic selector valve capable of switching a first position where the valve operating pressure controller is communicated with the valve main body and a second position where the valve body is communicated with the atmosphere, and a flow control valve for communicating the valve operating pressure controller and the valve main body with each other.

The valve main body is operated based on such a principle that, when a valve is closed, the plunger rod is brought into contact with a valve seat by utilizing resilient force of a spring, pneumatic pressure, or the like as a driving source, and when the valve is opened, the plunger rod is moved away from the valve seat by applying pressure greater than the resilient force of the spring, the pneumatic pressure, or the like. The direction and the speed in and at which the plunder rod is moved are determined depending on a pressure difference between the resilient force of the spring, the pneumatic pressure, or the like and applied air (i.e., a spring/air pressure difference). Accordingly, when the valve is closed from an open state, the pressure of the applied air is lowered to such an extent that the applied air pressure becomes lower than the resilient force of the spring, thus allowing the plunger rod to come into contact with the valve seat.

The plunger rod is provided at its fore end surface with a projection (sealing portion) having a maximum diameter that is equal to an inner diameter of the discharge orifice. The seating of the plunger rod onto the valve seat and the stop of movement of the plunger rod are precisely performed with surface contact between a surface of the valve main body against which the plunger rod strikes and the fore end surface of the plunger rod.

When the plunger rod is retracted from the closed position to be moved into the open position, the selector valve is shifted from the second position to the first position. Also, when the plunger rod is advanced from the open position to be moved into the closed position, the selector valve is shifted from the first position to the second position.

The air pressure is abruptly lowered to give the plunger rod a large acceleration, and the movement of the plunger rod is stopped at the same time as the plunger rod coming into contact with the valve seat. With that operation of the plunger rod, inertial force is applied to the liquid, thus causing the liquid to fly out in droplet form from the discharge orifice.

Figure 3:
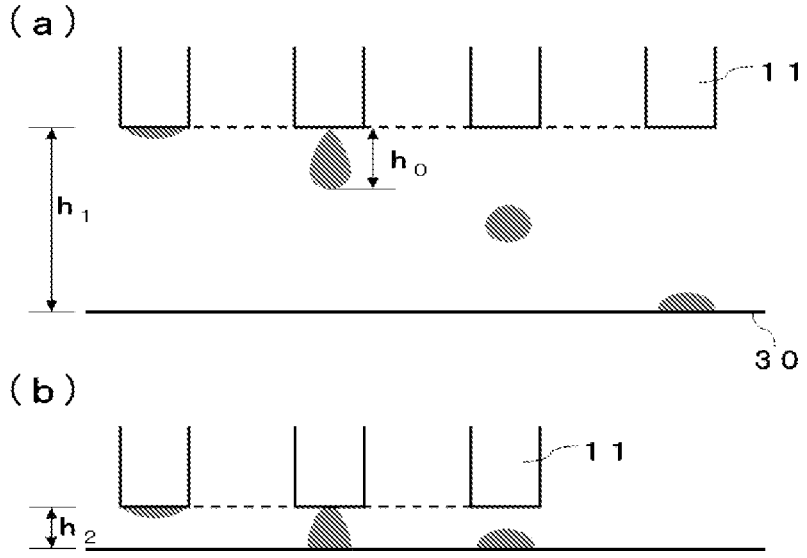
FIG. 3 is a side view to explain the positional relationship among a discharge orifice, a work, and a liquid droplet.

In the known discharging apparatus having the above-described construction, as shown in FIG. 3(*a*), the discharge operation is usually performed in such a condition that a distance $h_1$ between the discharge orifice and a work is several times or more a height $h_0$ of the liquid material in a state where the liquid material is still clung to the discharge orifice (nozzle) before coming into contact with the work. However, the technique of forming a liquid droplet on a work surface by causing the liquid material having flowed out from the discharge orifice to land in droplet form on the work surface has a problem regarding the accuracy of the landing position. More specifically, in the discharging apparatus in which the liquid material having flowed out from the discharge orifice is caused to land in droplet form on the work surface while the discharge orifice is moved at a high speed, inertial force acts on the liquid droplet having separated from the discharge orifice and the liquid droplet does not land on a position just under the discharge orifice which locates at the time of the discharging. In some discharging apparatuses, liquid droplets are discharged at a rate of several tens to several hundreds or more (e.g., 200 or more) per second while the discharge orifice is moved in parallel. The above-mentioned problem is more serious in the discharging apparatus for discharging the liquid droplets while the discharge orifice is moved at such a high speed.

As another problem, a satellite is generated when the liquid droplet separates from the discharge orifice.

In view of the above-described problems, the inventor has conducted intensive studies and has succeeded in solving those problems by setting relative positions of the discharge orifice and the work so as to provide an optimum distance.

Figure 8:
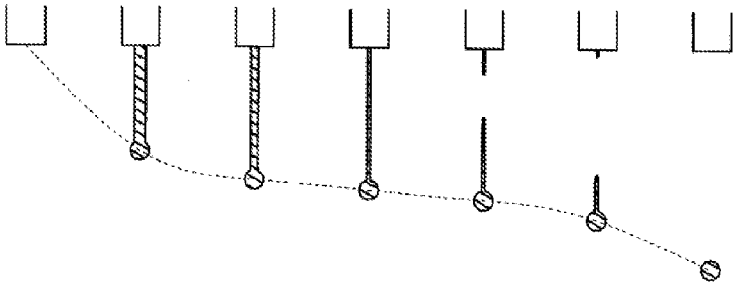
FIG. 8 is a side view to explain the present invention, the view showing changes of the liquid material having flowed out from the discharge orifice over time, including the discharge orifice.

FIG. 8 shows changes in the position of a liquid having flowed out from the discharge orifice, which is moved in parallel. When the liquid having flowed out from the discharge orifice is in a state where the discharged liquid is still clung to the discharge orifice at its string-like portion thinner than its fore end, a change in the horizontal position is small. But, after the discharged liquid is cut at the string-like portion, its falling speed abruptly increases. The satellite generated due to rebounding can be avoided by eliminating a time taken from the cutting of the string-like portion to the landing on the work. Thus, the soft landing on the work can be realized by setting a distance between the lowermost end of the liquid droplet and the work surface at the moment of separation of the liquid droplet from the discharge orifice to zero.

Be it noted that the fourth illustration counting from the left end in FIG. 8 represents the liquid droplet at the moment when the liquid droplet separates from the discharge orifice.

FIG. 3(*b*) indicates the case where a distance $h_2$ between the discharge orifice and the work is set to such a distance that the liquid droplet lands on the work in a state still clung to the discharge orifice, and the liquid droplet then separates from the discharge orifice. Stated another way, the distance $h_2$ between the discharge orifice and the work is smaller than the height $h_0$ of the liquid droplet, whereby the soft landing of the liquid material is realized. Therefore, the liquid material having flowed out from the discharge orifice first comes into contact with the work surface and then separates from the discharge orifice for application to the work. By setting the distance between the discharge orifice and the work to be smaller than the height $h_0$ of the liquid droplet, the inertial force acting on the liquid droplet is minimized and hence the landing position of the liquid droplet can be located substantially just under the discharge orifice. Further, because the liquid material separates from the discharge orifice to be cut after coming into contact with the work, the generation of the satellite can be suppressed.

What a value is to be set as $h_2$ is the matter of design determined depending on factors, such as the viscosity of the liquid material and the diameter of the discharge orifice. However, $h_2$ requires to be set to such a distance as allowing the liquid droplet to separate from the discharge orifice after landing on the work (namely, allowing the liquid material to be satisfactorily cut). In other words, it is important that $h_2$ is set to such a distance as enabling the liquid droplet to be formed with no need of raising the discharge orifice to cut the discharged liquid material at the string-like portion thereof. To that end, $h_2$ is preferably set to the same distance as the height $h_0$ of the liquid material immediately before the separation from the discharge orifice, or a slightly shorter distance (e.g., 60 to 100%, preferably 70 to 100%, more preferably 80 to 100%, and even more preferably 90 to 100% of the height $h_0$ of the liquid material). From the empirical rule based on experiments, it is disclosed herein that if the distance $h_2$ between the discharge orifice and the work is not larger than a half the height $h_0$ of the liquid material, satisfactory cutting of the liquid droplet from the discharge orifice cannot be obtained.

The height of the liquid material having flowed out from the discharge orifice immediately before the separation from the discharge orifice (i.e., the distance from the lower end of the discharge orifice to the lower end of the liquid material having flowed out from the discharge orifice) $h_0$ can be measured, for example, by using an image pickup device, e.g., a high-speed video camera. More specifically, the high-speed video camera is installed at a position horizontally spaced from the discharge orifice which is arranged so as to eject the liquid material vertically downwards, and a situation of the liquid material when it is discharged from the discharge orifice is recorded by the high-speed video camera. By analyzing a recorded image, the height $h_0$ of the liquid material immediately before the separation from the discharge orifice can be measured.

A method of measuring $h_0$ is not limited to the above described one. As another example, $h_0$ can also be measured by using a digital camera and taking an image at the moment when the liquid material separates from the discharge orifice.

In an ink jet type discharging apparatus using a liquid material with relatively low viscosity, for example, the liquid material having flowed out from the discharge orifice is discharged in droplet form and has a substantially spherical shape due to surface tension during dropping in many cases. However, the shape of the liquid material is not always changed through such a process depending on various conditions such as the viscosity of the liquid material and the ejection speed of the liquid material from the discharge orifice. The present invention is not intended for only liquid materials having low viscosity, e.g., ink. It is to be confirmed that the present invention is further intended for liquid materials having relatively high viscosity, such as a creamy solder, a silver paste, and an epoxy agent.

Examples of the liquid material to which the present invention is applicable include a conductive material such as a silver paste, an epoxy or acrylic resin material and adhesive, a solder paste, a liquid crystal material, a lubricant such as grease, an ink, a colorant, a paint, a coating material, an electrode material, an aqueous solution, oil, and an organic solvent.

The present invention is suitable for an operation of discharging the liquid material in a very small amount at a high accuracy. The present invention is suitably employed, for example, in operations of applying the liquid material to targets in manufacturing of electrical parts, such as semiconductors, or mechanical parts.

More specifically, the present invention is suitably employed, for example, in applying a very small amount of conductive agent, such as a silver paste, in manufacturing of electrical parts, applying grease to sliding regions of mechanical parts such as a motor, in applying an adhesive, such as an epoxy resin, to a very small bonded areas for bonding between members, in filling the liquid material between a chip and a substrate in manufacturing of semiconductors for underfilling, and in applying a sealant to an upper surface of a chip for sealing.

While a range of the discharge amount of the liquid material, which is usable in the present invention, is not limited to particular one, the present invention is especially advantageously suitable for the case of discharging the liquid material in a very small amount. For example, the present invention is preferably applied to the case where the discharge amount is not more than 100 mg, and more preferably applied to the case where the discharge amount is not more than 1 mg. The present invention is particularly effectively applied to the case where the discharge amount is from several nano-grams to 100 μg.

When the work surface is rugged and it is known that the distance between the work surface and the discharge orifice is not held within the range, described above with reference to FIG. 3(*b*), when the discharge orifice is moved in parallel, the discharge orifice is moved up and down such that the distance between the work surface and the discharge orifice is held within a preferable range. As practical means, it is here disclosed that a known distance measuring device, such as a sensor, is disposed near the discharge orifice and the liquid material is discharged while measuring the distance between the discharge orifice and the work surface.

Examples of the known distance measuring device includes a contact type measuring device brought into contact with the work surface to measure the distance up to the work surface, and a non-contact type measuring device, such as a laser displacement sensor irradiating a laser beam to a work and measuring the distance up to the work surface.

Further, the distance between the discharge orifice and the work surface (hereinafter referred to as the "clearance") is preferably always held constant within the above-described range. It is needless to say that the above-mentioned distance measuring device can also be utilized to always hold the distance between the discharge orifice and the work surface constant. The clearance is set to a value different depending on the type of the discharging apparatus, the discharge amount, etc. In the case of an ink jet type discharging apparatus, for example, the clearance is preferably not larger than 1 mm and more preferably not larger than 0.5 mm. In the case of a jet type discharging apparatus, for example, the clearance is preferably not larger than several millimeters and more preferably not larger than 1 mm.

The present invention is most effectively used in the case where the discharge orifice and the work are horizontally moved relative to each other. As described below, however, the present invention can also provide an advantageous effect in an operation of discharging the liquid material in a state where the discharge orifice and the work are stopped. When the liquid material is discharged so as to fly out in droplet form from the discharge orifice, the liquid droplet advances at a certain flying angle (i.e., an angle at which the liquid droplet ejected from the discharge orifice vertically downwards in a standstill state forms with respect to the vertical direction). The longer the distance between the discharge orifice and the work, the larger is a deviation of the landing position (i.e., a deviation between the desired landing position and the actual landing position). However, when the distance between the discharge orifice and the work is short, the deviation of the landing position can be minimized in any case.

Figure 4:
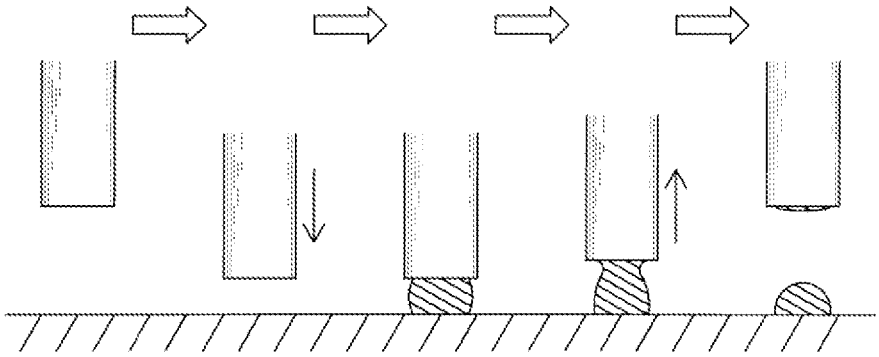
FIG. 4 is a side view to explain a known discharging method in which the discharge orifice is moved upwards and downwards.

Also, when the droplet separates from the discharge orifice after coming into contact with the work, the so-called rebounding upon the landing of the liquid droplet is not generated. Further, such a feature can provide the effect of generating no satellite, as in the known contact type discharging operation illustrated in FIG. 4.

The present invention can be practiced in various types of apparatuses for discharging the liquid material. The present invention can be applied to, for example, an air type apparatus in which air under regulated pressure is applied for a desired time to the liquid material reserved in a syringe having a nozzle provided at a fore end thereof, a tubing type apparatus including a flat tubing mechanism or a rotary tubing mechanism, a plunger type apparatus in which the liquid material is discharged by moving a plunger through a desired distance, which slides within a reservoir having a nozzle provided at a fore end thereof while the plunger is held in close contact with an inner surface of the reservoir, a screw type apparatus for discharging the liquid material with rotation of a screw, and a valve type apparatus in which the liquid material under application of desired pressure is controllably discharged by opening and closing a valve as required.

Besides, the present invention is most effectively applied to a discharging apparatus in which the liquid material is discharged in the "state of a liquid droplet" by application of inertial force. That type of discharging apparatus includes discharging apparatuses in which the liquid droplet is discharged by generating pressure in a liquid chamber communicating with a nozzle by using a pressure generation means, such as a movable valve member, an actuator of the electrostatic type and the piezoelectric type, a diaphragm, a hitting hammer, and a bubble generation heater. Practical examples of the discharging apparatuses include (i) the valve member seating jet type (e.g., the jet type discharging the liquid material by colliding a valve member against a valve seat), (ii) the valve member non-seating jet type (e.g., the plunger jet type discharging the liquid material by advancing a plunger and then abruptly stopping the plunger, thus applying inertial force to the liquid material), and (iii) continuous ejection or on-demand ink jet type.

While the present invention will be described in detail below in connection with embodiments, the present invention is in no way limited by the following embodiments.

Embodiment 1

Embodiment 1 relates to a discharging apparatus of the valve member seating jet type in which the liquid material is discharged in the state of a liquid droplet by bringing a valve member into contact with a valve seat.

Figure 2:
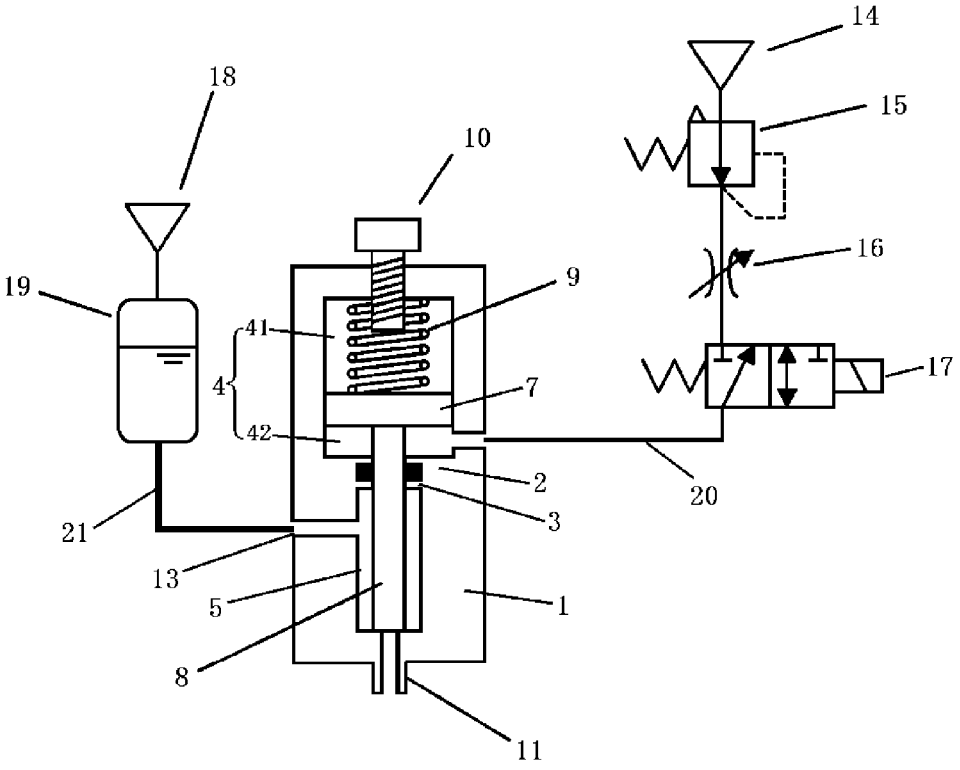
FIG. 2 is a schematic view of the discharging apparatus according to Embodiment 1 in a valve closed state (second position).

FIG. 1 is a schematic view showing respective states of various parts in a valve open state (first position), and FIG. 2 is a schematic view showing respective states of the various parts in a valve closed state (second position).

A valve main body 1 constituting a valve section is provided at its lower surface with a nozzle 11 for discharging a liquid droplet, and it is vertically divided into two chambers, i.e., a driver chamber 4 and a liquid chamber 5, by a partition 2 having a through-hole 3 for insertion of a plunger rod. A piston 7 for moving the plunger rod 8 upwards and downwards is slidably fitted in the driver chamber 4 on the upper side, and a portion of the driver chamber 4 located above the piston 7 forms a spring chamber 41. A spring 9 is disposed between an upper surface of the piston 7 and an upper inner wall surface of the spring chamber 41. Further, a portion of the driver chamber 4 located below the piston 7 forms an air chamber 42. The air chamber 42 is connected to a high-pressure pneumatic source 14 through a pipe 20, which is connected to a connection port 12 formed in a side wall of the valve main body 1, and through an air supply section such that high-pressure air for moving the plunger rod 8 backwards is supplied to the air chamber 42. Reference numeral 10 in the drawings denotes a stroke adjusting screw 10 which is screwed into an upper wall of the driver chamber 4. By changing a vertical position of the screw 10, an upper limit of movement of the plunger rod 8 is adjusted and hence the discharge amount of the liquid is also adjusted.

The plunger rod 8 moving forwards and backwards together with the piston 7 is extended into the liquid chamber 5, and a liquid chamber outlet 6 communicating with the nozzle 11 disposed at the lower surface of the valve main body 1 is formed in a bottom wall of the liquid chamber 5. Further, the liquid chamber 5 is connected to a liquid reservoir 19 through a pipe 21 connected to a connection port 13, which is formed in the side wall of the valve main body 1, whereby a liquid used for forming a liquid droplet is supplied to the liquid chamber 5.

The plunger rod 8 operates in such a manner that, when the plunger rod 8 advances, a fore end surface of the plunger rod 8 comes into contact with the bottom wall of the liquid chamber 5 to close the liquid chamber outlet 6. Accordingly, the length of the plunger rod 8 is set to such a value as enabling an air chamber to be formed under the piston 7 upon the plunger rod 8 coming into contact with the bottom wall of the liquid chamber 5 when the valve is closed.

The fore end surface of the plunger rod 8 and the bottom wall surface of the discharge chamber are formed to be flat such that, when the valve is closed, both the surfaces come into surface contact with each other to close the liquid chamber outlet 6, thus stopping the discharge of the liquid droplet. With such a construction, the liquid droplet to be discharged and the liquid remaining in the liquid chamber 5 can be reliably separated from each other when the valve is closed. In addition, by forming a projection, of which maximum diameter is equal to the inner diameter of the liquid chamber outlet 6, on the fore end surface of the plunger rod 8 and by engaging the projection with the liquid chamber outlet 6 when the valve is closed, the discharged liquid can be satisfactorily cut upon the closing of the valve.

The liquid supply section comprises a liquid pressurizing device 18 and a liquid reservoir 19 which is communicated with the liquid chamber 5 in the valve main body 1 by being constructed integrally with the valve main body 1 or through a pipe 21 connected to the valve main body 1 by using a joint. The liquid in the liquid reservoir 19 is controlled to be always held under a constant pressure by using air pressure that is regulated to a desired pressure by the liquid pressurizing device 18. While, in the illustrated embodiment, the liquid under pressure that is regulated by holding the pressure in the liquid reservoir 19 constant with the liquid pressurizing device 18 is supplied to the valve section, a pressure regulator may be disposed in a line connecting a liquid supply source (not shown) and the valve section such that the liquid under pressure regulated by the pressure regulator is supplied to the valve section.

The air supply section comprises a valve operating pressure controller 15, a flow control valve 16, and a selector valve 17, which are connected in series. More specifically, the flow control valve 16 is disposed between the electromagnetic selector valve 17 communicating with the valve main body 1 and the valve operating pressure controller 15 which controls air for operating the plunger rod 8 to a desired pressure.

The selector valve 17 can be switched between a first position where the flow control valve 16 communicating with the valve operating pressure controller 15 controller and the valve main body 1 are communicated with each other to bring the plunger rod 8 into an open position, and a second position where the air chamber 42 in the driver chamber 4 and the atmosphere are communicated with each other to bring the plunger rod 8 into a closed position. In such a way, the selector valve 17 selectively switches the direction of movement of the plunger rod 8.

With the above-described construction, when the plunger rod 8 in the closed position is retracted to move into the open position, the selector valve 17 is shifted from the second position to the first position. In the first position, the air for operating the plunger rod 8, controlled to be held under the desired pressure, is further controlled in flow rate by the flow control valve 16 and then supplied to the valve main body 1. Upon the supply of the operating air, the plunger rod 8 is started to move backwards at a desired speed. Because the plunger rod 8 can be moved at the desired speed, air bubbles can be prevented from being sucked through the fore end of the liquid chamber outlet 6 even when the stroke of the plunger rod 8 is set to a large value.

Also, when the plunger rod 8 in the open position is advanced to move into the closed position, the selector valve 17 is shifted from the first position to the second position. In the second position, because the valve main body 1 and the atmosphere are communicated with each other, the air for operating the plunger rod 8, which has served to move the plunger rod 8 backwards, is released to the atmosphere at a time and the pressure of the air for operating the plunger rod becomes equal to the atmospheric pressure in a moment. Accordingly, the spring 9 having been contracted to a state storing energy is expanded at a time to move the plunger rod forwards. Thereafter, the movement of the plunger rod is abruptly stopped upon the plunger rod coming into contact with the valve seat, whereby only the liquid is discharged in the form of a liquid droplet from the liquid chamber outlet 6.

In the apparatus constructed as described above, accuracy in discharging the liquid has been checked by setting the distance between the lower end of the discharge orifice and the work surface (i.e., the clearance) to different conditions. As a result, it has been confirmed that the satellite is not generated at the clearance set in accordance with this embodiment, whereas the satellite is generated at the clearance set to a value much larger than that set in accordance with this embodiment.

Embodiment 2

Embodiment 2 relates to a discharging apparatus of the valve member seating jet type discharging the liquid material in the state of a liquid droplet by bringing a valve member into contact with a valve seat.

<<Construction>>

Figure 9:
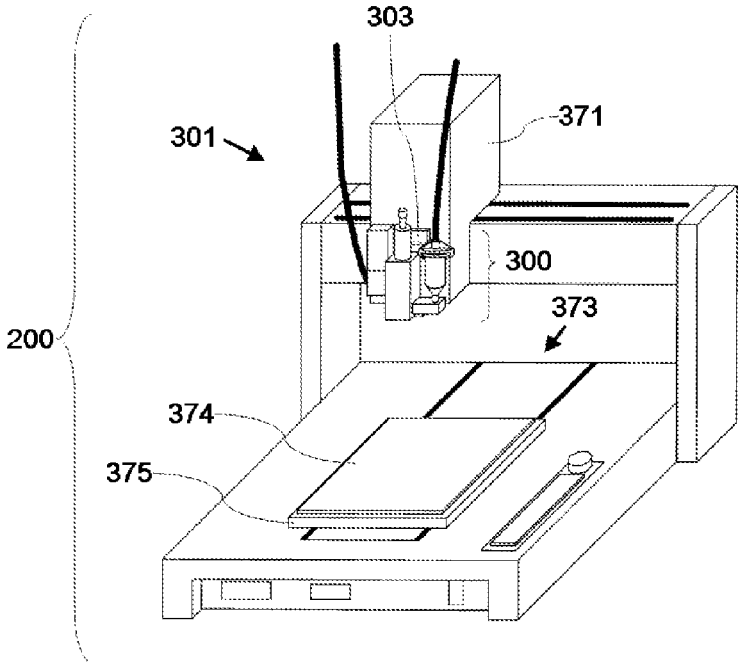
FIG. 9 is an external appearance perspective view of an applying apparatus provided with a discharging apparatus according to Embodiment 3.

FIG. 9 is an entire external appearance view of a liquid material applying apparatus provided with a discharging apparatus according to this embodiment.

In a liquid material applying apparatus 200, a discharging apparatus 300 is mounted to a discharge head of a desktop robot 301, and the liquid material is applied in a desired amount to a desired position on a work 374 while the work 374 and the discharging apparatus 300 are moved relative to each other.

The discharging apparatus 300 is detachably fixed to a Z-direction moving mechanism 303, which is included in an X-direction moving mechanism 371 of the desktop robot 301, to be freely movable in the X-direction. The work 374 is placed on a table 375, which is disposed on a Y-direction moving mechanism 373 of the desktop robot 301. The discharging apparatus 300 is freely movable in the Z-direction and is able to adjust the distance between the discharging apparatus 300 and the surface of the work 374 (i.e., the clearance) to a desired value when the discharging apparatus 300 discharges the liquid material.

Figure 5:
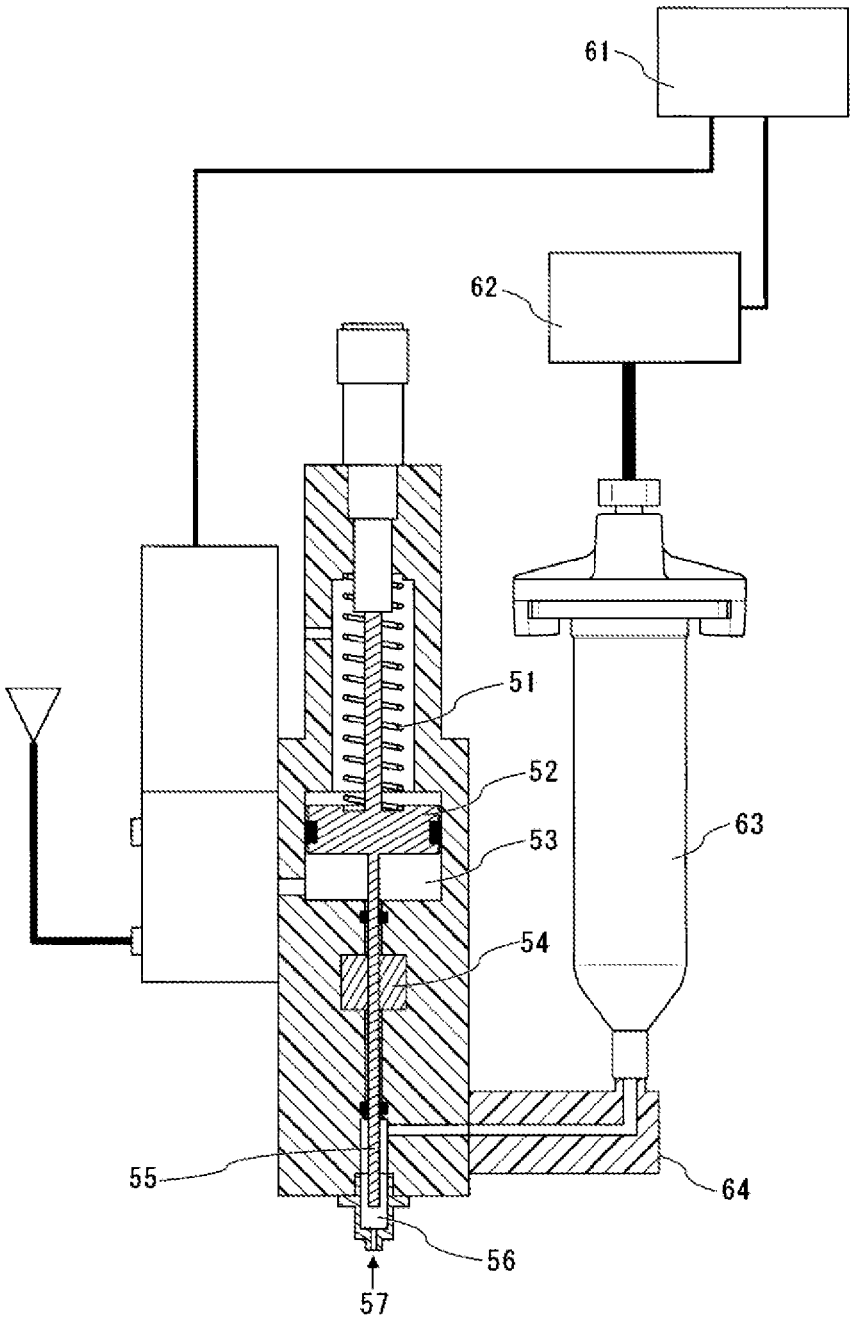
FIG. 5 is an external appearance view, partly sectioned, of a discharging apparatus according to Embodiment 2.

In the discharging apparatus 300 of this embodiment, as detailed in FIG. 5, a piston 52 is fixed to a rear end of a plunger 55 such that the piston 52 is biased forwards by a spring 51 from the rear side. The piston 52 is retracted together with the plunger 55 by supplying air to a space in a piston chamber 53 on the side forward of the piston 52. The plunger 55 is advanced by releasing the air on the side forward of the piston 52 to the atmosphere, whereby a part of the liquid material in a liquid chamber 56 is discharged in the state of a liquid droplet from a discharge orifice. The plunger 55 is stopped upon coming into contact with an inner wall of the liquid chamber 56, which is positioned forward of the plunger.

In the apparatus thus constructed, because the plunger 55 is advanced while a peripheral surface of its fore end portion is held in a state not in contact with the inner wall of the liquid chamber 56, a part of the liquid material is allowed to move backwards through a gap between the plunger 55 and the liquid chamber 56. Therefore, resistance against the advance of the plunger 55 is small and the plunger 55 can be smoothly advanced at a high speed.

<<Preparation>>

By operating the discharging apparatus 300 which has been controlled into a condition capable of discharging the liquid material in a desired amount, a height (distance) $h_0$ from a discharge orifice 57 to a foremost end of the liquid material in the direction of extension thereof is measured at the time when the liquid material separates from the discharge orifice 57 of the discharging apparatus 300. The height $h_0$ may be measured before the discharging apparatus 300 is mounted to the desktop robot 301, or in a state of the discharging apparatus 300 being mounted to the desktop robot 301 by placing a cup for receiving the discharged liquid material below the discharging apparatus 300 and discharging the liquid material from the discharging apparatus 300 toward the cup. When measuring the height $h_0$, it is important to set the distance between the discharge orifice 57 and an application target to such a value that the liquid material separates from the discharge orifice 57 before landing on the application target.

The measuring operation can be performed, as described above, by taking images of a situation of the liquid material being discharged from the discharge orifice 57 of the discharging apparatus 300 with a high-speed video camera, selecting one of the taken images representing the moment at which the liquid material separates from the discharge orifice, and executing image processing on the selected image.

In this embodiment, the high-speed video camera is used to measure the height $h_0$ from the discharge orifice 57 to the foremost end of the liquid material in the direction of extension thereof at the time when the liquid material separates from the discharge orifice 57 of the the satellite has been confirmed in the case of setting the clearance to a value much larger than that set in accordance with this embodiment.

<<Applying Operation>>

After the height $h_0$ of the liquid material at the time when the liquid material separates from the discharge orifice 57 has been obtained with the above-described procedures, an applying operation is performed as follows. The Z-direction moving mechanism 303 is controlled while the applying operation by the applying apparatus 200 such that the applying operation is performed on condition where the distance between the work to which the liquid material is applied and the discharge orifice 57 of the discharging apparatus 300 is smaller than the height $h_0$.

The discharging apparatus 300 of this embodiment is an apparatus capable of discharging various liquid materials having a wide range of viscosity from several tens cps to several hundred thousands cps. Thus, the discharging apparatus 300 can discharge liquid materials having relatively high viscosity as well. The discharge amount is approximately several μg to several tens mg per shot.

In the apparatus constructed as described above, generation of the satellite has been checked by setting the distance between the lower end of the discharge orifice and the work surface (i.e., the clearance) to such a condition that the liquid material separates from the discharge orifice of the nozzle after landing on the work. As a result, the generation of the satellite has not been confirmed at the clearance set in accordance with this embodiment. On the other hand, the generation of the satellite has been confirmed in the case of setting the clearance to a value much larger than that set in accordance with this embodiment.

Discharging apparatus: jet type discharging apparatus (valve member seating type)

Nozzle: inner diameter=75 μm, outer diameter=200 μm

Liquid material: thermosetting epoxy based one-component resin

Discharge amount: 10 μg

Distance between the discharge orifice and the work surface (i.e., clearance): 1 mm Relative moving speed between the discharge orifice and the work: 50 mm/s

Embodiment 3

Embodiment 3 relates to a discharging apparatus of the valve member non-seating jet type in which the liquid material is discharged in the state of a liquid droplet by moving a plunger forwards and then abruptly stopping the plunger, thus applying inertial force to the liquid material.

Figure 7:
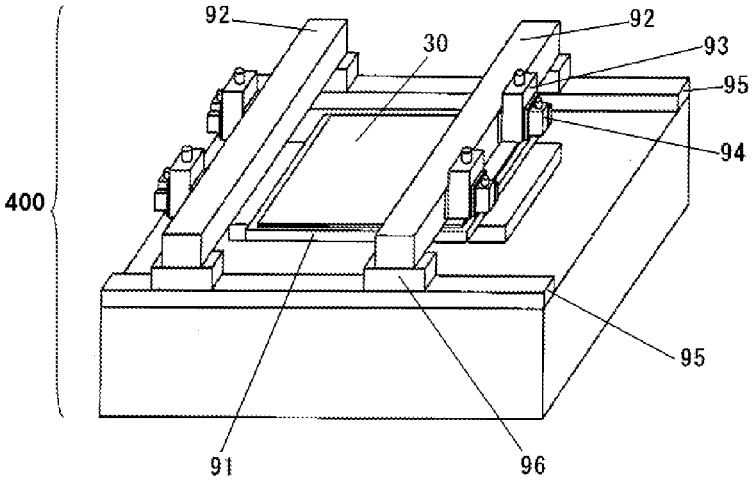
FIG. 7 is an external appearance perspective view of an applying apparatus provided with a discharging apparatus according to Embodiment 3.

As shown in FIG. 7, a discharging apparatus 500 of this embodiment is mounted to a gantry type applying apparatus 400.

The gantry type applying apparatus 400 is an apparatus in which the liquid material is applied to a desired position on the surface of a work by moving a nozzle for discharging the liquid material and a table for holding a work thereon in an opposed relation to the nozzle relative to each other in a box, for example. The gantry type applying apparatus 400 comprises a loading/unloading opening which is formed in a side surface of the box for carrying the work into and out of the box, beam moving means for moving beams, which are extended toward the loading/unloading opening, above the table in parallel, and a control unit for controlling operations of the above-mentioned components. The gantry type applying apparatus 400 is described in more detail below.

The gantry type applying apparatus 400 of this embodiment comprises, as shown in FIG. 7, a table 91 on which the work is placed, a pair of X-axis slide bases 95 extending in the X-axis direction in parallel with the table 91 interposed therebetween, and two beams 92 supported on X-axis sliders 96 and extending in the Y-axis direction.

The table 91 includes a θ-rotation mechanism for moving the work in the θ-axis direction to be positioned at a predetermined angle. The table 91 may be directly supported by the θ-rotation mechanism which is disposed under the table 91, or may be placed on a moving mechanism, which is moved in the X-axis direction or the Y-axis direction, so as to assist relative movement performed by the X-axis slider/the Y-axis slider.

Two X-axis sliders 96 capable of moving in the longitudinal direction of the X-axis slide bases are disposed on each of the pair of X-axis slide bases 95 such that the X-axis sliders 96 support both the ends of the two beams 92. With the X-axis sliders 96 moving on the X-axis slide bases 95, the beams 92 are freely movable in the X-direction above the table 91.

The X-axis slide bases 95 are located at a spacing therebetween, which is sufficient so as not to cause interference with the work when the beams 92 are located at respective end positions. With such an arrangement, the beams 92 and an applying head 94 can be prevented from interfering with the work when the work is carried in.

Two Y-axis sliders 93 are disposed on each of outer lateral surfaces of the pair of beams 92, and the applying head 94 for discharging the liquid material is disposed on each of the Y-axis sliders 93 to be movable in the Z-axis direction. For example, the X- and Y-axis slide bases include linear motor magnets and guides for straight movement, whereas the sliders include linear motors. However, the combination of the slide base and the slider is not limited to the above-mentioned one. As another example, the slide base may include a motor and a ball screw rotating with operation of the motor, and the slider may include a nut moving straightly with rotation of the ball screw.

<<Operation>>

When the work is carried in, a main control unit moves the X-axis sliders 96 for moving the beam 92 on the right side to the right ends of the X-axis slide bases 95 and moving the beam 92 on the left side to the left ends of the X-axis slide bases 95 such that the beams 92 are not positioned over the table 91. After completion of the movement of the beams 92, a work conveying machine 17 loads the work through the loading/unloading opening 12. When the operation of placing the work on the table 91 is completed, the main control unit 21 moves the X-axis sliders 96 and the Y-axis sliders 93 such that the applying head 94 is located at the desired position on the work. Then, the applying head 94 is descended by the Z-direction moving mechanism disposed on the applying head 94, and the liquid material is applied to the work. On that occasion, the applied liquid material can be drawn in a desired shape by moving the X-axis sliders 96 and the Y-axis sliders 93 as appropriate.

After completion of the operation of applying the liquid material, the main control unit 21 moves the X-axis sliders 96 for moving the beam 92 on the right side to the right ends of the X-axis slide bases 95 and moving the beam 92 on the left side to the left ends of the X-axis slide bases 95 such that the beams 92 are not positioned over the table 91. After completion of the movement of the beams 92, the work conveying machine 17 unloads the work through the loading/unloading opening 12.

The work can be loaded and unloaded by using a fork type conveying machine or an air type conveying machine.

The discharging apparatus 500 comprises a liquid material supply section for supplying a liquid material to be discharged, a discharge section having a discharge orifice through which the liquid material is discharged, a measuring section including a measuring bore and a plunger moving in slide contact with an inner wall surface of the measuring bore to suck and deliver the liquid material into and from the measuring bore, a valve section including a main body and a valve member having a flow passage communicating the liquid material supply section and the measuring section with each other and a flow passage communicating the measuring section and the discharge section with each other, the valve member sliding within a space formed in the main body, and a control section for controlling those components.

Figure 10:
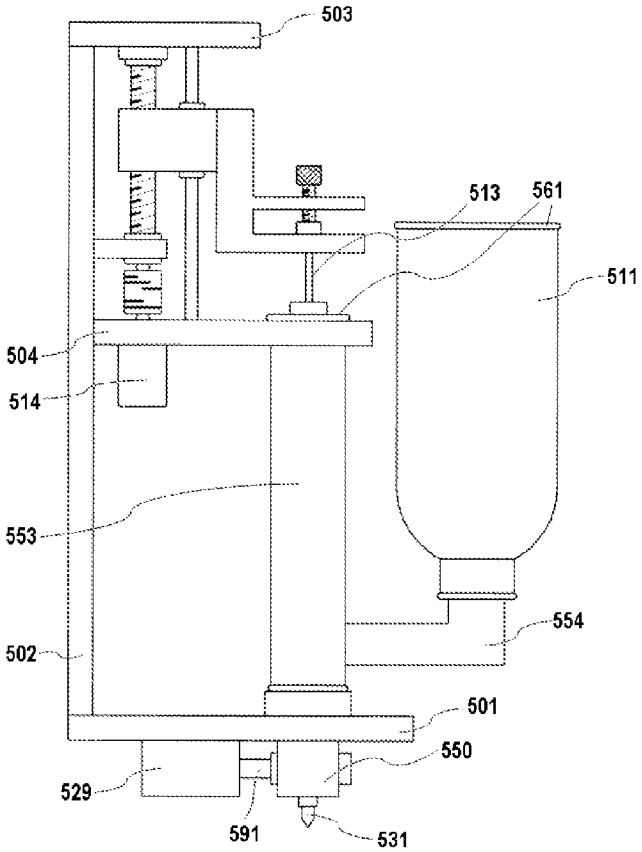
FIG. 10 is an external appearance side view of a discharging apparatus according to Embodiment 3.
Figure 11:
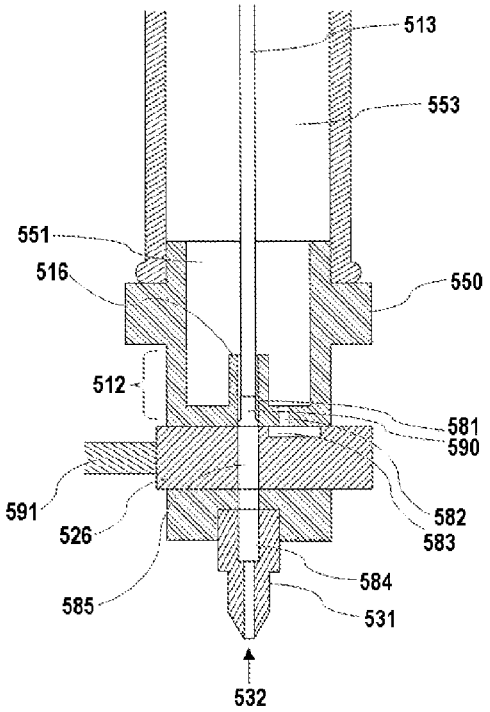
FIG. 11 is a partial enlarged sectional view showing a first position of a valve member of the discharging apparatus according to Embodiment 3.
Figure 12:
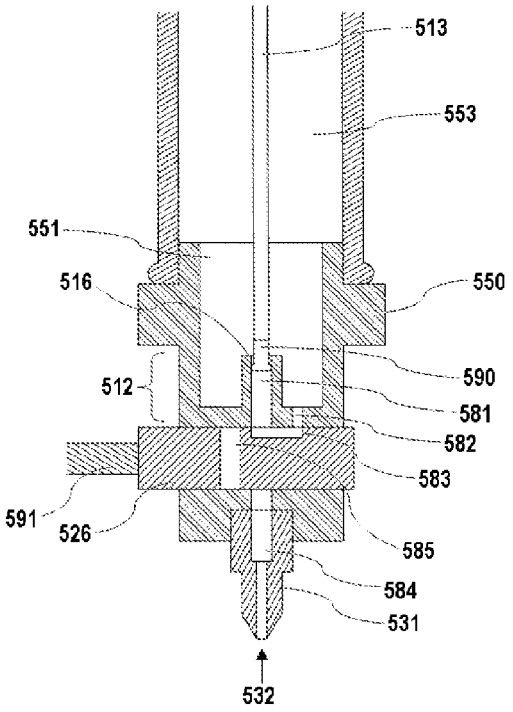
FIG. 12 is a partial enlarged sectional view showing a second position of the valve member of the discharging apparatus according to Embodiment 3.

In the discharging apparatus 500, as shown in FIGS. 10 to 12, advancing and retracting operations of a valve driving actuator 529 fixed to a lower surface of a base 501 are transmitted to a valve member 526 through a joint 591 which is coupled to the valve driving actuator 529. Accordingly, the valve member 526 is caused to slide with the advancing and retracting operations of the valve driving actuator 529.

When the liquid material is sucked into the measuring bore, the control section shifts the valve member to a first position where the liquid material supply section and the measuring section are communicated with each other and the communication between the measuring section and the discharge section is shut off. When the liquid material in the measuring bore is delivered, the control section shifts the valve member to a second position where the measuring section and the discharge section are communicated with each other and the communication between the liquid material supply section and the measuring section is shut off.

In the discharging apparatus 500 of this embodiment, the liquid material having relatively low viscosity from several cps to several hundreds cps is discharged in amount of about 0.1 mg to several mg per shot.

The discharging apparatus 500 of this embodiment can also be utilized, for example, as a liquid crystal dripping apparatus that is used in a liquid crystal dripping step in a process of manufacturing a liquid crystal panel.

In the apparatus constructed as described above, a deviation of the landing position (including a deviation caused by rebounding) and generation of the satellite have been checked by setting the distance between the lower end of the discharge orifice and the work surface (i.e., the clearance) to such a condition that the liquid material separates from the discharge orifice of the nozzle after landing on the work. As a result, the generation of the satellite has not been confirmed at the clearance set in accordance with this embodiment. On the other hand, the generation of the satellite has been confirmed in the case of setting the clearance to a value much larger than that set in accordance with this embodiment.

Embodiment 4

Embodiment 4 relates to an ink jet type discharging apparatus.

The discharging apparatus of this embodiment will be described with reference to FIGS. 6 and 13.

Figure 6:
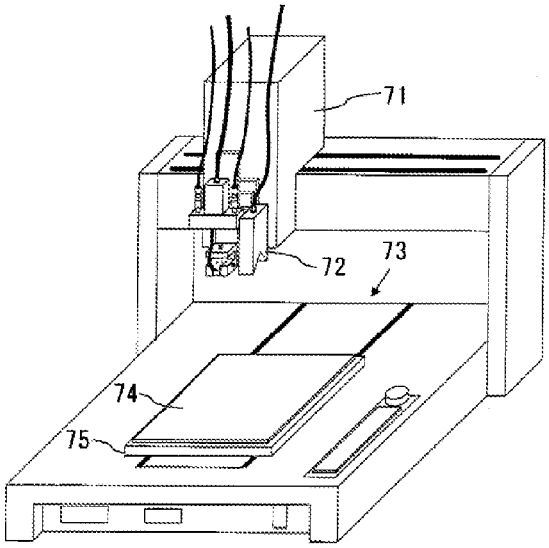
FIG. 6 is a perspective external appearance view of an applying apparatus provided with a discharging apparatus according to Embodiment 4.

FIG. 6 shows a liquid material discharging apparatus in which the liquid material is applied while a discharge head 600 and a work are moved relative to each other. The discharge head 600 is freely movable in the Z-direction. A displacement of the discharge head 600 can be measured by using a moving element 641, which includes a contact sensor 4, and the clearance between a discharge surface of an ink jet head 1 and a work 7 can be adjusted.

Figure 13:
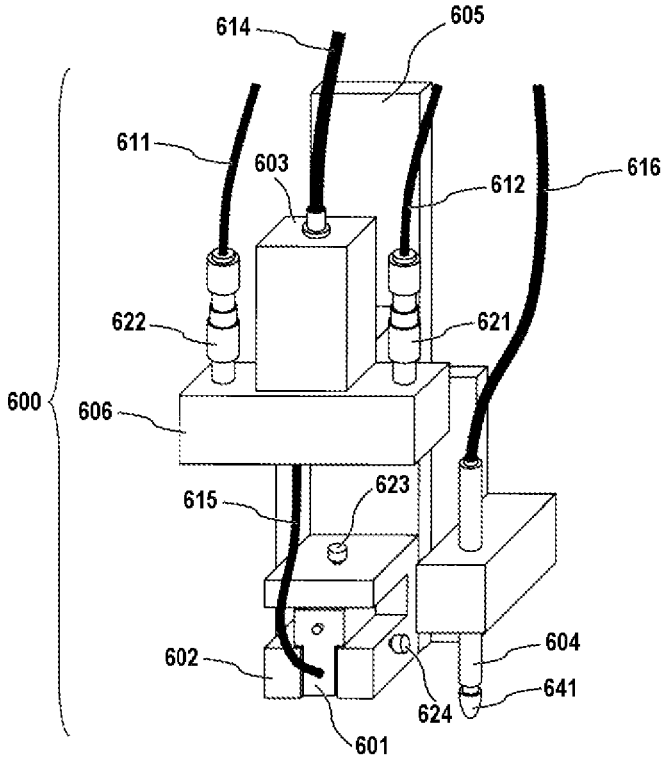
FIG. 13 is an external appearance perspective view of a discharge head according to Embodiment 4.

The discharge head 600 of this embodiment comprises, as shown in FIG. 13, a known ink jet head 601 having pressure generating means to generate pressure within a liquid chamber which is communicated with a nozzle, a head holding member 602 for holding the ink jet head 601 in a detachable manner, and a switching mechanism which is selectively connected to a liquid supply passage and a pressurized air supply passage. The ink jet discharge head is featured in that the switching mechanism selectively supplies one of a liquid and pressurized air to the ink jet head 601.

The ink jet head 601 can be attached to and detached from the head holding member 602 by loosening screws 623 and 624. Tubes made of a flexible material are also easily attached to and detached because joint connection is used for each tube, thus providing a structure easier for maintenance.

The nozzle of the ink jet head 601 mounted to the discharge head 600 may be single or plural in number.

In the discharging apparatus of this embodiment, the liquid material having low viscosity from several cps to several tens cps, for example, is discharged in amount of about several ng per shot.

In the apparatus constructed as described above, a deviation of the landing position and generation of the satellite have been checked by setting the distance between the lower end of the discharge orifice and the work surface (i.e., the clearance) to such a condition that the liquid material separates from the discharge orifice of the nozzle after landing on the work. As a result, the deviation of the landing position and the generation of the satellite have not been confirmed at the clearance set in accordance with this embodiment. On the other hand, the generation of the satellite has been confirmed in the case of setting the clearance to a value much larger than that set in accordance with this embodiment.

The invention claimed is:

1. A method for discharging a liquid material by a discharging apparatus capable of moving a work and a discharge orifice relative to each other and discharging the liquid material in the state of a liquid droplet through the discharge orifice, the method comprising:

a first step of setting a distance between the lower end of the discharge orifice and a work surface to such a distance as enabling a distance between a lower end of the liquid droplet and the work surface to be approximately zero, at the time when the liquid droplet separates from the discharge orifice; and a second step of forming a dot of the liquid material, whose amount is substantially equal to that of the liquid material at the time when the liquid material discharged separates from the discharge orifice as a single droplet, on the work by discharging the liquid material.

2. The method for discharging the liquid material according to claim 1, wherein the distance between the lower end of the discharge orifice and the work surface in the first step is such a distance as enabling the liquid material having flowed out from the discharge orifice to be cut after landing on the work and enabling the liquid material to separate from the discharge orifice without moving the discharge orifice.

3. The method for discharging the liquid material according to claim 1, further comprising, prior to the first step, a step of obtaining a distance from the lower end of the discharge orifice to a lower end of a droplet of the liquid material discharged from the discharge orifice at the time when the liquid material discharged separates from the discharge orifice as a single droplet.

4. The method for discharging the liquid material according to claim 1, wherein the discharging apparatus comprises a liquid chamber communicating with the discharge orifice, and a plunger which advances and retracts within the liquid chamber, and discharges the liquid material from the discharge orifice, by a single advancing movement of the plunger.

5. The method for discharging the liquid material according to claim 1, wherein the discharging apparatus comprises a distance obtaining device for obtaining the distance between the work and the discharge orifice.

6. The method for discharging the liquid material according to claim 1, wherein the liquid material is discharged while the work and the discharge orifice are horizontally moved relative to each other.

7. A method for discharging the liquid material, the method comprising a step of filling a liquid material between a chip and a substrate for semiconductors by the method for discharging the liquid material according to claim 1.

8. A method for discharging the liquid material, the method comprising a step of applying a sealant to an upper surface of a chip for semiconductors by the method for discharging the liquid material according to claim 1.

9. An apparatus for discharging a liquid material in the state of a liquid droplet through the discharge orifice, comprising:

a discharge section including a discharge orifice, a work holding mechanism for holding a work at a position opposed to the discharge orifice, a discharge distance adjusting mechanism capable of adjusting a distance between a lower end of the discharge orifice and a work surface, and a control section, wherein the control section is configured to perform the steps of: (a) setting a distance B between the lower end of the discharge orifice and a work surface to such a distance as enabling a distance between a lower end of the liquid droplet and the work surface to be approximately zero, at the time when the liquid droplet separates from the discharge orifice, and (b) controlling the discharge distance adjusting mechanism such that the distance between the lower end of the discharge orifice and the work surface is held the distance B when the liquid material is discharged from the discharged orifice, thereby forming a dot of the liquid material, whose amount is substantially equal to that of the liquid material at the time when the liquid material discharged separates from the discharge orifice as a single droplet, on the work.

10. The apparatus for discharging the liquid material according to claim 9, wherein the distance B in the step of (a) is such a distance as enabling the liquid material having flowed out from the discharge orifice to be cut after landing on the work and enabling the liquid material to separate from the discharge orifice without moving the discharge orifice.

11. The apparatus for discharging the liquid material according to claim 9, further comprising a distance obtaining device for obtaining a distance from the lower end of the discharge orifice to a lower end of a droplet of the liquid material, wherein the control section, prior to the step of (a), performs the step of obtaining the distance from the lower end of the discharge orifice to the lower end of the droplet of the liquid material discharged from the discharge orifice, by the distance obtaining device, at the time when the liquid material discharged separates from the discharge orifice as a single droplet.

12. The apparatus for discharging the liquid material according to claim 9, further comprising a liquid chamber communicating with the discharge orifice and the plunger which advances and retracts within the liquid chamber, wherein the apparatus discharges the liquid material from the discharge orifice, by a single advancing movement of the plunger.

13. The apparatus for discharging the liquid material according to claim 9, further comprising a distance obtaining device for obtaining a distance between the lower end of the discharge orifice and the work surface.

14. The apparatus for discharging the liquid material according to claim 9, further comprising a horizontally relatively moving mechanism for horizontally moving the work and the discharge orifice relative to each other, wherein the control section holds the distance between the work and the discharge orifice constant.

* * * * *